US007178210B2

(12) United States Patent
Noelle et al.

(10) Patent No.: US 7,178,210 B2
(45) Date of Patent: Feb. 20, 2007

(54) INSTALLATION FOR PRODUCING NON-WOVEN TEXTILE WEBS WITH JET FLUIDS LEAVING NO VISIBLE MARK

(75) Inventors: Frédéric Noelle, Saint Nazaire les Eymes (FR); Jean-Michel Dubus, Nantes en Ratier (FR)

(73) Assignee: Rieter Perfojet, Montbonnot (FR)

( * ) Notice: Subject to any disclaimer, the term of this patent is extended or adjusted under 35 U.S.C. 154(b) by 494 days.

(21) Appl. No.: 10/470,404

(22) PCT Filed: Oct. 19, 2001

(86) PCT No.: PCT/FR01/03250

§ 371 (c)(1),
(2), (4) Date: Jan. 16, 2004

(87) PCT Pub. No.: WO02/055777

PCT Pub. Date: Jul. 18, 2002

(65) Prior Publication Data

US 2004/0111847 A1 Jun. 17, 2004

(30) Foreign Application Priority Data

Jan. 16, 2001 (FR) ..... 01 00526

(51) Int. Cl.
*D04H 1/46* (2006.01)

(52) U.S. Cl. ..... 28/104; 28/167

(58) Field of Classification Search ..... 28/104, 28/105, 167, 103, 106, 169; 68/200, 201, 68/204, 205 R; 442/408; 156/166, 167, 156/181, 441; 264/211.13, 211.14
See application file for complete search history.

(56) References Cited

U.S. PATENT DOCUMENTS

| | | | | |
|---|---|---|---|---|
| 3,214,819 | A | 11/1965 | Guerin | |
| 3,434,188 | A * | 3/1969 | Summers | 28/104 |
| 3,493,462 | A | 2/1970 | Bunting et al. | |
| 3,508,308 | A * | 4/1970 | Bunting, Jr. et al. | 28/104 |
| 3,620,903 | A * | 11/1971 | Bunting et al. | 442/415 |
| 3,833,438 | A | 9/1974 | Kaneko et al. | |
| 3,906,130 | A | 9/1975 | Tsurumi et al. | |
| 3,906,599 | A | 9/1975 | Smith, II | |
| 4,173,077 | A | 11/1979 | Birke et al. | |
| 4,252,590 | A | 2/1981 | Rasen et al. | |
| 4,387,476 | A * | 6/1983 | Bueb et al. | 8/151.2 |
| 4,519,804 | A | 5/1985 | Kato et al. | |
| 4,647,490 | A * | 3/1987 | Bailey et al. | 428/131 |
| 4,765,100 | A * | 8/1988 | Majors | 451/32 |
| 5,789,328 | A * | 8/1998 | Kurihara et al. | 442/387 |
| 6,105,222 | A | 8/2000 | Fleissner | |
| 6,592,713 | B2 * | 7/2003 | Ahoniemi | 162/103 |

(Continued)

FOREIGN PATENT DOCUMENTS

DE 1 635 634 7/1970

(Continued)

*Primary Examiner*—A. Vanatta
(74) *Attorney, Agent, or Firm*—Knobbe, Martens, Olson & Bear LLP

(57) ABSTRACT

The invention concerns an installation for producing non-woven textile webs comprising a conveyor on one side of which the non-woven textile web passes between an injector and a vacuum chamber driven in an oscillating motion. The resulting web bears no mark.

17 Claims, 3 Drawing Sheets

U.S. PATENT DOCUMENTS

| | | | | |
|---|---|---|---|---|
| 2001/0018786 | A1* | 9/2001 | Greenway et al. | 28/104 |
| 2002/0078538 | A1* | 6/2002 | Ngai | 28/104 |

FOREIGN PATENT DOCUMENTS

| | | |
|---|---|---|
| DE | 1 635 643 | 6/1971 |
| DE | 2 148 327 | 4/1973 |
| EP | 0 491 383 | 6/1992 |
| FR | 2 601 970 | 1/1988 |

* cited by examiner

INSTALLATION FOR PRODUCING NON-WOVEN TEXTILE WEBS WITH JET FLUIDS LEAVING NO VISIBLE MARK

RELATED APPLICATIONS

This application is the U.S. National Phase of PCT/FR01/03250 filed Oct. 19, 2001 and claims priority to French Patent Application No. 01/00526 filed Jan. 16, 2001, which is hereby incorporated by reference herein.

BACKGROUND OF THE INVENTION

1. Field of the Invention

The invention relates to an improvement to installations for producing nonwoven fibrous webs, the cohesion of which is obtained by intermingling of fibres in the thickness of the said web by the action of small-diameter high-speed fluid jets, more particularly water jets.

2. Description of the Related Art

U.S. Pat. No. 3,906,130 relates to a perforated nonwoven. Moreover, in that document, oscillations are intended to promote the transverse deposition of the filaments and the formation of filament loops.

FIG. 5 of that document also shows that the members delivering the water jets (reference 36) intended for consolidating the web of filaments are placed on a non-oscillating conveyor 15 independent of the oscillating conveyor 1 on which the filaments are deposited. The inventor specifies that the items 33, 34 and 35 placed above the conveyor 1 are nozzles for impregnation with a caustic soda solution for a scouring treatment. This caustic soda treatment can in no way be likened to consolidation by water jets, in other words to hydraulic entanglement of fibres. This is usually carried out at pressures not exceeding 5 bar and by flat or conical jets.

Finally, no mention is made of the marks of the jets disappearing, which goes without saying since the members delivering the water jets for the purpose of consolidating the filaments by hydraulic entanglement are installed on a non-oscillating conveyor.

U.S. Pat. No. 4,252,590 relates to a process for forming a web of continuous filaments, the transverse properties of which are improved by a transverse movement of the support 3.

The above document explains that an increase in the transverse strength of the web is obtained if the support itself undergoes a transverse movement.

Nowhere in that document is it mentioned that water jets are used to produce hydraulic entanglement of the filaments, nor is any disappearance of the lines left by the water jets in the filament web.

U.S. Pat. No. 3,833,438 discloses a particular spinning system called "wet" spinning in which the extruded and coagulated filaments are received on a conveyor undergoing a transverse oscillatory movement.

It is clearly specified that, in FIG. 1, the references 29 and 30 correspond to impregnation systems for acid or basic chemical treatments, as is practiced on webs of filaments after the latter have been spun.

That document does not mention the use of water jets for producing hydraulic entanglement of the filaments, nor any disappearance of the lines left by the water jets in the web of filaments.

It was proposed long ago, as is apparent from U.S. Pat. No. 3,214,819 and U.S. Pat. No. 3,508,308, to produce nonwoven fabric webs in which the cohesion is provided by the interlacing of the elementary fibres, the interlacing being obtained by the action of pressurized water jets that act on the fibrous structure and allow some of the constituent fibres of the web to be reoriented in the direction of the thickness.

The water jets used to interlace the fibres leave visible impressions on the surface of the nonwovens.

It has already been envisaged, as is apparent from U.S. Pat. No. 3,493,462, to impress oscillations on the water jets in order to obtain nonwovens without marks and without visible features.

The vibrations transmitted to the hydraulic equipment induce premature ageing of the equipment and introduce hazards for the operators.

SUMMARY OF THE INVENTION

The aim of the present invention is to provide an installation for producing nonwoven fibrous webs allowing the fibres of a nonwoven web to be entangled by means of water jets without having visible marks or impressions of the water jets in and on the surface of the nonwoven webs and without, however, requiring the hydraulic equipment to undergo movement.

The subject of the invention is an installation for producing nonwoven fibrous webs that includes a conveyor along the top side of which a nonwoven fibrous web passes beneath an injector which blasts the web with fluid jets, and preferably above a box communicating with a vacuum source. The invention provides a means intended to give the conveyor an oscillatory movement at least partly transverse with respect to the direction in which the top side runs.

Although the conveyor is already moving and it is more difficult to impart an additional oscillatory movement on it than on the injector, the invention ignores this preconception however, by nevertheless making the conveyor oscillate, because it is now understood that an injector has hydraulic component can age prematurely and be likely to crack when subjected to vibrations, and, because of the high pressures involved, its repeated displacement is liable to cause dangerous leaks of fluid.

Injector oscillation techniques, like conveyor oscillation techniques, have the drawback of making very large masses move. The injector weighs between 1000 and 1500 kg. Devices allowing such large masses to move are extremely expensive.

This is why, according to a much preferred embodiment, the installation is such that the fibrous web passes between the injector and a box communicating with a vacuum source and the above means is designed so as to impart the oscillatory movement on the box.

Owing to the effect of the vacuum created in the box, the conveyor is applied thereto and follows the movement thereof. Thus, a very simple means has been found to give the conveyor, and therefore the fibrous web that is pressed against it by the effect of the vacuum, an oscillatory movement while leaving the injector stationary. It is very much easier to impart an oscillatory movement on an essentially empty box which therefore does not weigh much than on the injector or even directly on the conveyor.

The oscillatory movement may be purely perpendicular to the direction in which the top side runs, but it may also be inclined with respect to this direction, the essential point being that there is a component of the oscillatory movement that is perpendicular to the direction in which the top side runs and to the direction of the jets, which is usually vertical.

Good results have been obtained for an oscillation amplitude of between 0.2 and 5 mm and for a number of oscillations of from 5 to 100 per second.

Preferably, the frequency in Hz represents from 2 to 20 times the speed of the web expressed in m/min, this speed of the web being preferably between 5 and 50 m/min.

Preferably, the number of jets is between 12 and 77 jets/cm on that part of the web receiving the jets.

Preferably, the fluid expelled by the injector is a liquid, and especially water. The jets expel fluids at a pressure of preferably between 20 and 600 bar. The jets are cylindrical and emanate from nozzles from 80 to 170 microns in diameter in order to give jets of the same shape and diameter.

According to one embodiment, the box is mounted so as to be suspended on elastic means, especially on springs or flexible mountings.

The conveyor is usually a metal or plastic endless conveyor and the fluid can pass through the conveyor.

According to one embodiment, several injectors are associated with one and the same box. The fact that there is only a single oscillating box beneath several injectors, especially two or three injectors, avoids having two boxes undergoing their own movement, which could create undesirable harmonics.

BRIEF DESCRIPTION OF DRAWINGS

In the appended drawings, given solely by way of example.

DETAILED DESCRIPTION OF THE PREFERRED EMBODIMENT

Figure 1:
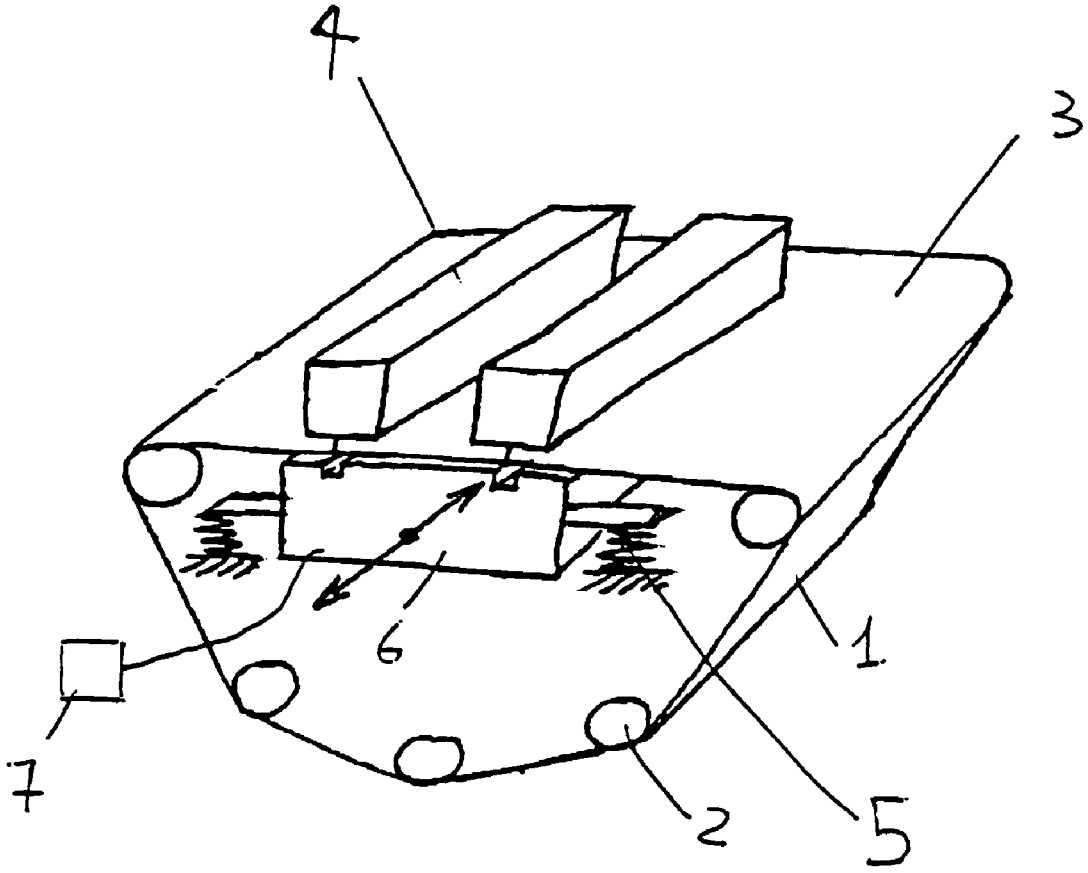
FIG. 1 is a schematic perspective view of an installation according to the invention.
Figure 2:
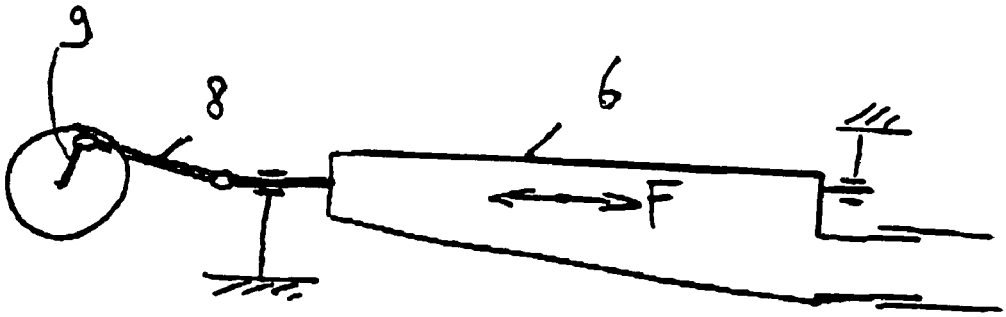
FIG. 2 illustrates a means intended to impart an oscillatory movement on the box.
Figure 3:
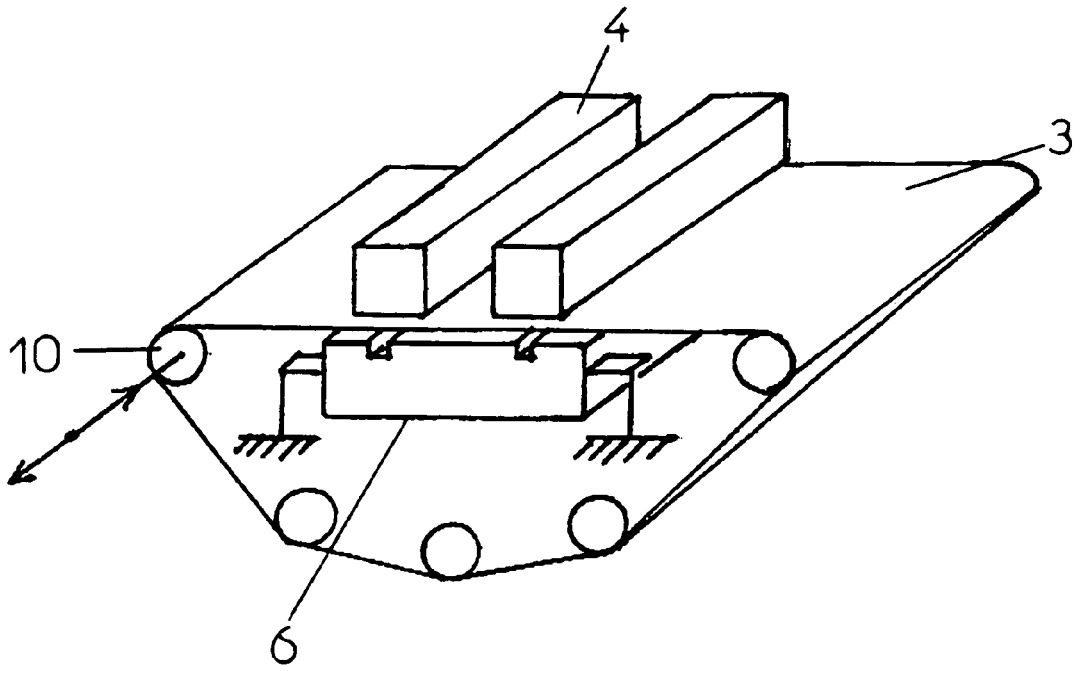
FIG. 3 illustrates an alternative embodiment.

FIG. 1 is a schematic perspective view of an installation according to the invention. FIG. 2 illustrates a means intended to impart an oscillatory movement on the box. FIG. 3 illustrates an alternative embodiment.

The installation according to the invention, allowing nonwoven fibrous webs to be produced without leaving a mark, by jumbling of the lines, comprises an endless conveyor 1 passing over rolls 2 and having a top side 3 along which a nonwoven fibrous web (not shown) whose fibres have to be better entangled, passes. For this purpose, two banks of injectors 4 delivering 120 μm diameter water jets at 300 bar are provided. These jets are directed vertically onto the web 3 and, in that part plumb with the injectors 4, there are fifty jets per centimetre of web. Mounted on springs 5 beneath the top side 3 of the conveyor, and facing the injector 4, is a box 6 communicating with a vacuum source 7. The box is given, by means shown in FIG. 2, an oscillatory movement, indicated symbolically by the double arrow F, that is horizontal and perpendicular to the direction in which the top side 3 runs. The amplitude of the oscillations is 4 mm. The box undergoes fifty oscillations per second.

The oscillatory movement is obtained by a device comprising a connecting rod 8 and a crank 9 driven in rotation by a motor (not shown).

Of course, other means could be used to impart an oscillatory movement on the box, for example a rotary vibrator, a piston-type linear vibrator or a cam mechanism.

In FIG. 3, the oscillatory movement is communicated by a piston vibrator to a roller 10 for returning the top side 3 of the conveyor 1.

The invention claimed is:

1. Installation for producing nonwoven fibrous webs, that includes a conveyor configured such that, along a top side of the conveyor, a nonwoven fibrous web can pass beneath an injector adapted to blast the web with fluid jets at a pressure of between 20 and 600 bar and an oscillatory device arranged to induce onto the conveyor an oscillatory movement at least partly transverse with respect to the direction in which the top side of the conveyor runs.

2. Installation according to claim 1, characterized in that the oscillatory device is arranged to impart the oscillatory movement on a return roll of the conveyor.

3. Installation according to claim 1, characterized in that the fibrous web passes between the injector and a box communicating with a vacuum source and wherein the oscillatory device is arranged so as to impart the oscillatory movement on the box.

4. Installation according to claim 1, characterized by an oscillation amplitude of 0.2 to 5 mm.

5. Installation according to claim 1, characterized by a number of oscillatory movements of 5 to 100 per second.

6. Installation according to claim 1, characterized by a frequency in Hz of the oscillatory movement representing from 2 to 20 times the speed of the web in m/min.

7. Installation according to claim 1, characterized by a web speed of between 5 and 10 m/min.

8. Installation according to claim 1, characterized by a number of jets of between 12 and 77 jets per centimeter on that part of the web facing the injector.

9. Installation according to claim 3, characterized in that the box is mounted so as to be elastically suspended.

10. Installation according to claim 3, comprising a plurality of injectors and wherein the box is arranged beneath the plurality of injectors.

11. Installation according to claim 1, characterized by cylindrical jets having a diameter of between 80 and 170 microns.

12. An installation for producing nonwoven fibrous webs, the installation comprising:

a conveyor configured such that a nonwoven fibrous web can pass along a top side of the conveyor;

at least one injector configured to blast the web with fluid jets;

a vacuum source;

a box communicating with the vacuum source and wherein the box is arranged such that the web is interposed between the box and the at least one injector; and an oscillatory device arranged to induce an oscillatory movement on the box and the conveyor, the oscillatory movement being at least partly transverse with respect to the direction in which the top side of the conveyor runs.

13. The installation of claim 12, wherein the oscillatory device is arranged to induce the oscillatory movement to the box and wherein the box is coupled to the conveyor via vacuum provided by the vacuum source such that the oscillatory movement of the conveyor is induced via the vacuum coupling to the oscillating box.

14. The installation of claim 12, wherein the at least one injector is adapted to provide a jet pressure of between 20 and 600 bar.

15. The installation of claim 12, wherein the at least one injector is arranged above the box.

16. The installation of claim 12, wherein a frequency in Hz of the oscillatory movement corresponds to 2 to 20 times a longitudinal speed of the web in m/min.

17. An installation for producing nonwoven fibrous webs, the installation comprising:

a conveyor configured such that, along a top side of the conveyor, a nonwoven fibrous web can pass beneath an injector adapted to blast the web with fluid jets;

a box communicating with a vacuum source and arranged such that the web passes between the box and the injector and wherein the box is elastically suspended; and an oscillatory device arranged to induce onto the conveyor an oscillatory movement at least partly transverse with respect to the direction in which the top side of the conveyor runs.

* * * * *